US007432434B2

(12) United States Patent
Yanase et al.

(10) Patent No.: US 7,432,434 B2
(45) Date of Patent: Oct. 7, 2008

(54) ELECTRONIC MUSICAL APPARATUS AND SERVER COMPUTER

(75) Inventors: Tsutomu Yanase, Hamamatsu (JP); Satoru Umezawa, Kakegawa (JP); Takeo Shibukawa, Iwata-gun (JP)

(73) Assignee: Yamaha Corporation (JP)

( * ) Notice: Subject to any disclaimer, the term of this patent is extended or adjusted under 35 U.S.C. 154(b) by 617 days.

(21) Appl. No.: 11/017,358

(22) Filed: Dec. 20, 2004

(65) Prior Publication Data

US 2005/0132869 A1 Jun. 23, 2005

(30) Foreign Application Priority Data

Dec. 22, 2003 (JP) ..... 2003-424622

(51) Int. Cl.
*G10H 7/00* (2006.01)

(52) U.S. Cl. ..... 84/600; 715/238; 84/601

(58) Field of Classification Search ..... 84/600–603; 715/238

See application file for complete search history.

(56) References Cited

U.S. PATENT DOCUMENTS

| | | | | |
|---|---|---|---|---|
| 2002/0087425 | A1 | 7/2002 | Tokuhiro et al. | |
| 2003/0061115 | A1 | 3/2003 | Wachi | |
| 2003/0136247 | A1* | 7/2003 | Mizuno | 84/600 |
| 2003/0167904 | A1* | 9/2003 | Itoh | 84/609 |

FOREIGN PATENT DOCUMENTS

| | | | |
|---|---|---|---|
| JP | 2002-203125 | | 7/2002 |
| JP | 3350553 | B2 | 9/2002 |
| JP | 2003-99037 | A | 4/2003 |
| JP | 2003-208384 | A | 7/2003 |
| WO | 98/15091 | A1 | 4/1998 |

OTHER PUBLICATIONS

Office Action issued in corresponding Japanese patent application No. 2003-424622, mailed Dec. 18, 2007.

* cited by examiner

*Primary Examiner*—David S. Warren
(74) *Attorney, Agent, or Firm*—Rossi, Kimms & McDowell, LLP.

(57) ABSTRACT

An electronic musical apparatus M1 transmits apparatus ID information and a common page access signal to a server computer SC. The server computer SC receives the signal and apparatus ID information. On the basis of the apparatus ID information, the server computer SC searches a user database 106*a* to identify the model of the electronic musical apparatus M1. The server computer SC also retrieves content data of a dedicated page for the identified model from a content data storage section 106*b*. The retrieved content data is created in accordance with display capabilities of a display unit 13 of the electronic musical apparatus M1. The server computer SC then transmits the retrieved content data to the electronic musical apparatus M1. As a result, the user of the electronic musical apparatus M1 can view the information contained in the whole dedicated page in colors on the display unit 13 without the need for scrolling. Thus, the present invention delivers legible information to various different types of electronic musical apparatuses having a display unit with different display capabilities.

11 Claims, 10 Drawing Sheets

ELECTRONIC MUSICAL APPARATUS AND SERVER COMPUTER

BACKGROUND OF THE INVENTION

1. Field of the Invention

The present invention relates to an electronic musical apparatus having a display unit, and more particularly to an electronic musical apparatus that displays, on a display unit, information retrieved from a server computer with which the electronic musical apparatus can communicate.

2. Description of the Related Art

As disclosed in JP2002-203125A, for example, a selling method has been widely known in which users purchase items from traders over a network. By this selling method, users place orders through user computers, and traders deliver items through traders' computers. Both the user computers and trader computers are connected with a network. On this selling method, a user connects his/her computer with a trader's computer on a web site through a network, and chooses on a display unit an item provided by the trader.

The above-described conventional selling method is designed to display various information on a display (display unit) disposed on a user's terminal, i.e., a computer so that a user can retrieve information. However, computers currently used by users vary widely, and display capabilities of a display unit also vary depending on the computer. Due to the variety of display units, modes for displaying information such as display area, resolution and coloring mode vary among display units. Some display units require complicated operations for browsing retrieved information. In other words, computers with a small display area require users to scroll a screen or specify a desired position to view retrieved information.

In the case of electronic musical apparatuses that can communicate with an external apparatus (a server computer), some electronic musical apparatuses which are not provided with a pointing device such as a mouse have difficulty in scrolling a screen or specifying a desired position for viewing retrieved information. Users of such electronic musical apparatuses may not be able to view retrieved information with simple operation. Depending on the number or types of operators, furthermore, some electronic musical apparatuses may cause difficulty for users in viewing retrieved information or specifying a desired position. Therefore, it is desirable to be able to provide various information that are supported by display capabilities of a display unit and operational capabilities of operators of each apparatus, so that users can view retrieved information with simple operation.

SUMMARY OF THE INVENTION

The present invention was accomplished to solve the above-described problem, and an object thereof is to deliver legible information to various electronic musical apparatuses each of which has a display unit having different display capabilities or operators having different operational capabilities.

In order to achieve the above-described object, a feature of the present invention lies in an electronic musical apparatus which generates a musical tone signal and communicates with an external apparatus in order to retrieve various information, the electronic musical apparatus comprising an operating portion which is operated by a user in order to cause the electronic musical apparatus to execute various operations; a display portion for legibly displaying tone control information necessary for controlling generation of the musical tone signal and the various information; a storage portion for storing identification information provided in order to identify the electronic musical apparatus; a connecting and transmitting portion for connecting to a storage area disposed in the external apparatus and used in common by a plurality of electronic musical apparatuses including the electronic musical apparatus, and transmitting the identification information stored in the storage portion to the external apparatus; and a receiving portion for receiving, from the external apparatus, various information applicable to display capabilities of the display portion or operational capabilities of the operating portion.

When being connected to an external apparatus (e.g., a server computer connected to a network), the electronic musical apparatus constituted as described above is able to receive, by transmitting identification information (ID) of the electronic musical apparatus, various information applicable to the display capabilities of its display portion or operational capabilities of its operating portion. Due to this constitution, various different types of electronic musical apparatuses having a display portion with display capabilities (e.g., display area, resolution, capability of displaying in color) unique to respective type and operating portion with operational capabilities unique to respective type are allowed to retrieve information best applicable to the display capabilities and operational capabilities of respective electronic musical apparatus. As a result, all the users of those various different electronic musical apparatuses can easily obtain legible information.

Another feature of the present invention lies in an electronic musical apparatus which generates a musical tone signal and communicates with an external apparatus in order to retrieve various information, the electronic musical apparatus comprising an operating portion which is operated by a user in order to cause the electronic musical apparatus to execute various operations; a display portion for legibly displaying tone control information necessary for controlling generation of the musical tone signal and the various information; a storage portion for storing connection information necessary for connecting to a specific storage area disposed in the external apparatus and provided specifically for the model of the electronic musical apparatus; a connecting portion for connecting to the specific storage area disposed in the external apparatus on the basis of the connection information stored in the storage portion; and a receiving portion for receiving, from the specific storage area disposed in the external apparatus, various information applicable to display capabilities of the display portion or operational capabilities of the operating portion.

The electronic musical apparatus constituted as described above is able to connect directly to a specific storage area disposed in the external apparatus (e.g., a server computer connected to a network), that is, to a dedicated page provided for respective electronic musical apparatus, on the basis of connection information (e.g., URL, etc.). In this specific storage area there is stored various information applicable to display capabilities and operational capabilities of the electronic musical apparatus, so that the electronic musical apparatus is allowed to retrieve information that is best suited to its display capabilities. Therefore, a user of the electronic musical apparatus can easily obtain legible information. Furthermore, the electronic musical apparatus may have two types of destination to access first; a common storage area which is shared by electronic musical apparatuses and a specific storage area which is provided specifically for the electronic musical apparatus. Therefore, each of various different types of electronic musical apparatuses can obtain various information without fail by using the common connection information or dedicated connection information. Moreover, the number of operating means (operators) of the electronic musical apparatus can be reduced because the operating means is commonly used to specify both the fundamental capabilities of the electronic musical apparatus (selection of tone color, song, accompaniment style, etc.) and various instructions based on the obtained information.

Still another feature of the present invention lies in a server computer which is connected to a network and provides an external terminal connected to the network with various information, the server computer comprising a database for storing identification information necessary for identifying the external terminal and type information representative of the type of the external terminal with associated relation established between the identification information and the type information; a storage portion for storing various information applicable to the type of the external terminal identified on the basis of the type information; a receiving portion for receiving identification information from the external terminal; a type identifying portion for searching the database on the basis of the identification information received by the receiving portion and identifying the type of the external terminal; an information retrieving portion for retrieving various information applicable to the external terminal from the storage portion on the basis of the type identified by the type identifying portion; and an information providing portion for providing the external terminal with various information retrieved by the information retrieving portion. This constitution may be adapted such that the various information applicable to the type of the external terminal is created on the basis of display capabilities of a display unit or operational capabilities of operators disposed on the external terminal.

The server computer constituted as described above stores various information created on the basis of display capabilities of a display unit and operational capabilities of operators disposed in the external apparatus (e.g., electronic musical apparatus, etc.). As a result, the server computer is able to provide information that is suited to display capabilities and operational capabilities of the external terminal (e.g., electronic musical apparatus, etc.) which is connected to the server computer. Therefore, a user of the external terminal can easily obtain provided information.

A further feature of the present invention lies in a computer-readable program that is applied to electronic musical apparatuses and server computers similar to the above and realizes functions described above.

DESCRIPTION OF THE PREFERRED EMBODIMDENT

1. First Embodiment

Figure 1:
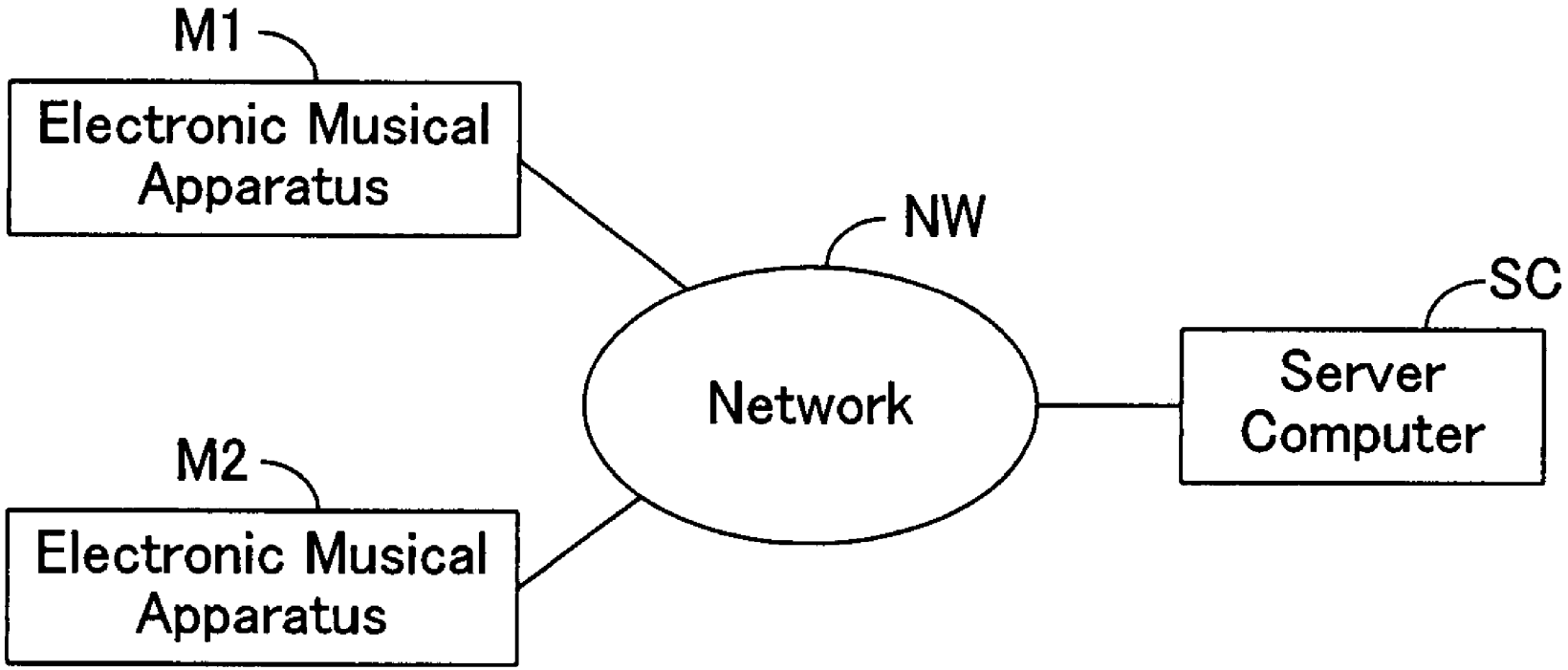
FIG. 1 is a schematic block diagram showing a network to which electronic musical apparatuses and a server computer according to a first embodiment and second embodiment of the present invention are connected.

A first embodiment of the present invention will now be described with reference to the drawings. FIG. 1 is a block diagram showing an electronic musical apparatus M1, electronic musical apparatus M2 and server computer SC according to the present invention that are connected to a network NW to allow communications.

Figure 2:
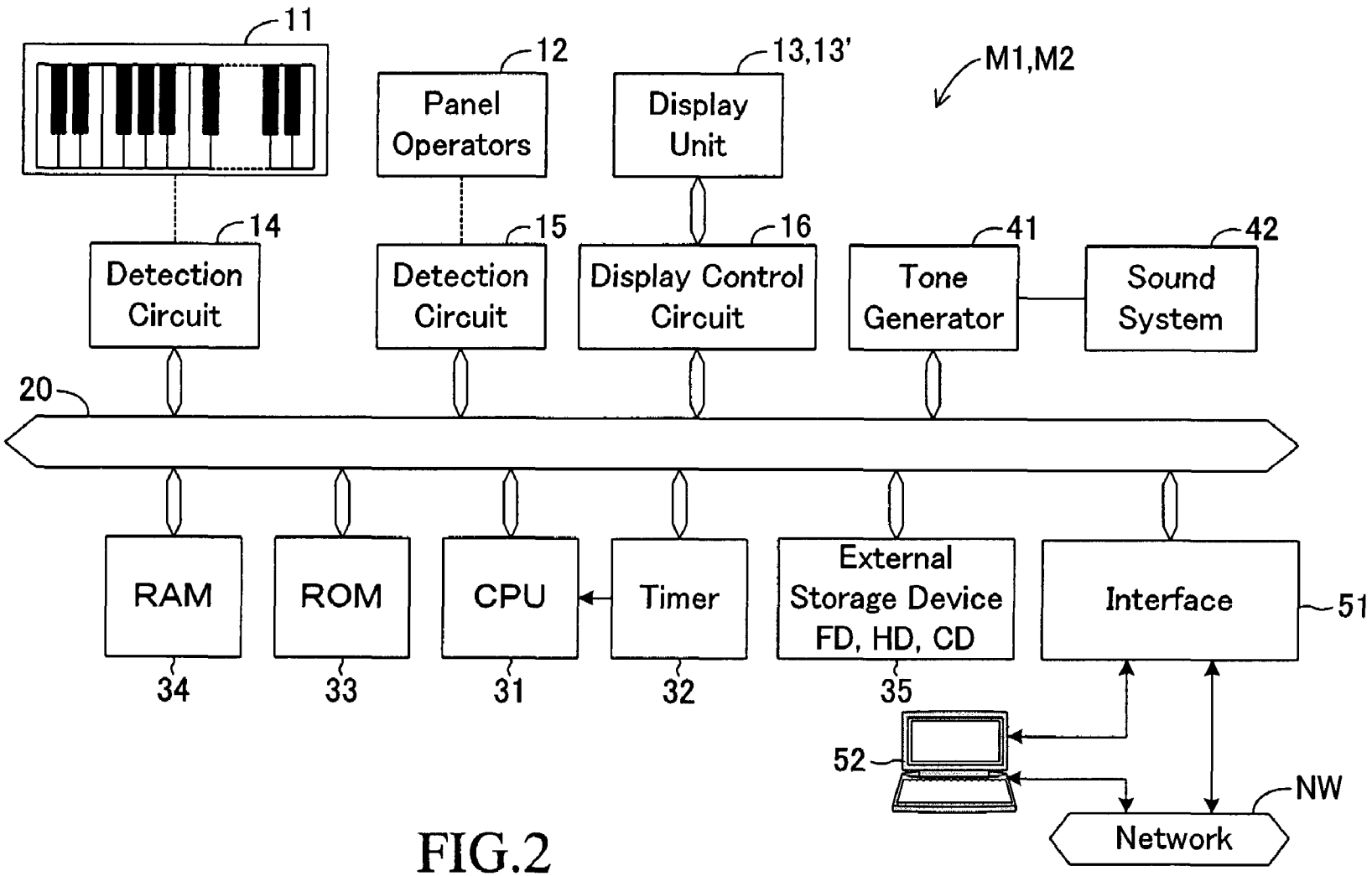
FIG. 2 is a schematic block diagram of the electronic musical apparatuses according to the first embodiment and second embodiment of the present invention shown in FIG. 1.

The electronic musical apparatus M1, which is an electronic musical instrument, for example, has a keyboard 11, panel operators 12, and a display unit 13 as shown in FIG. 2. The keyboard 11 is composed of a plurality of keys used as performance operators. The depression and release of each key cause generation and halt of a musical tone signal, respectively. The depression and release of keys are detected by ON/OFF operation of key switches, respectively. The key switches provided in corresponding relation to the keys are disposed in a detection circuit 14 which is connected to a bus 20.

The panel operators 12 are formed of a multiplicity of operators that include pushbuttons and are provided on a front panel (more specifically, on the periphery of the display unit 13) of the electronic musical apparatus M1. The panel operators 12 are operated by a user in order to trigger various operations of the electronic musical apparatus M1. Respective operations of the panel operators 12 are detected by ON/OFF operation of operator switches. The operator switches provided in corresponding relation to each operator are disposed in a detection circuit 15 that is connected to the bus 20. The display unit 13, which is configured by a liquid crystal display, etc. displays characters, notes, graphics, and later-explained various content items retrieved from the server computer SC. The display unit 13 has a wide display area (in other words, high resolution), and is capable of displaying in color. Display modes of the display unit 13 are controlled by a display control circuit 16 that is connected to the bus 20.

Connected to the bus 20 are a CPU 31, timer 32, ROM 33, RAM 34, external storage device 35, tone generator 41 and sound system 42. The CPU 31, timer 32, ROM 33 and RAM 34, which configure the main unit of a microcomputer, control various operations of the electronic musical apparatus M1 by executing programs.

Figure 3:
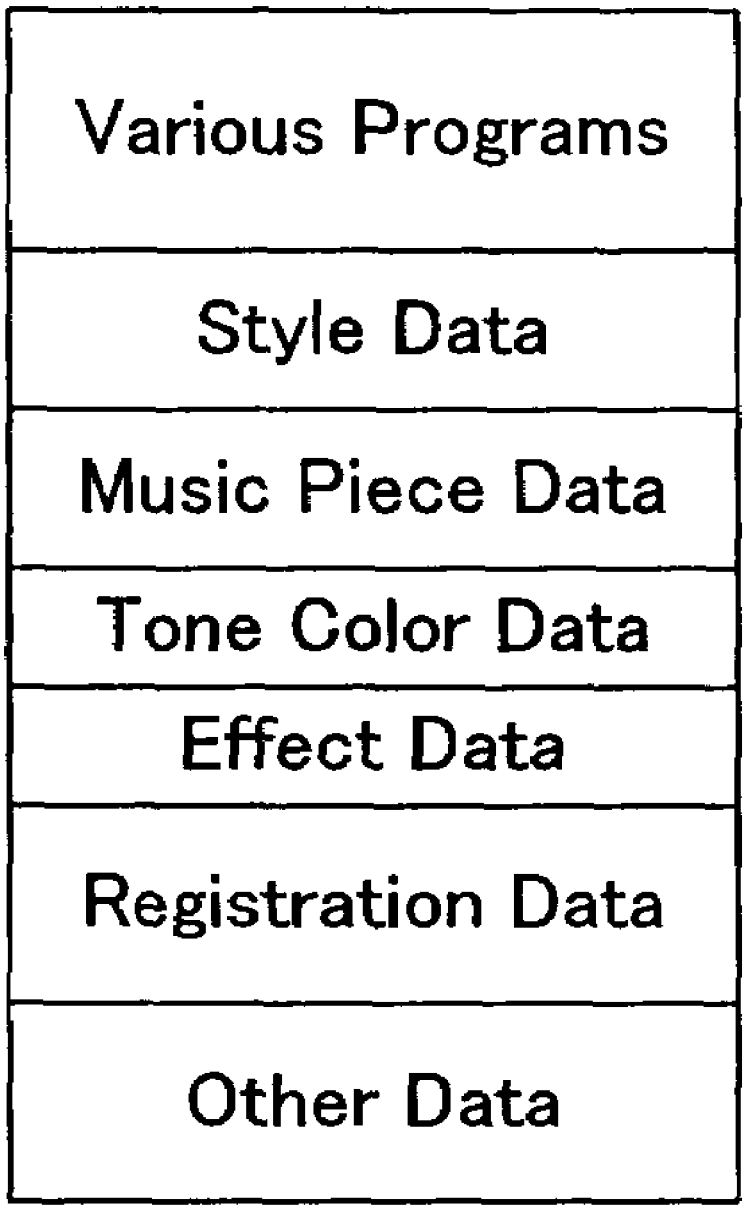
FIG. 3 is a map showing various storage areas of a ROM shown in FIG. 2.
Figure 7:
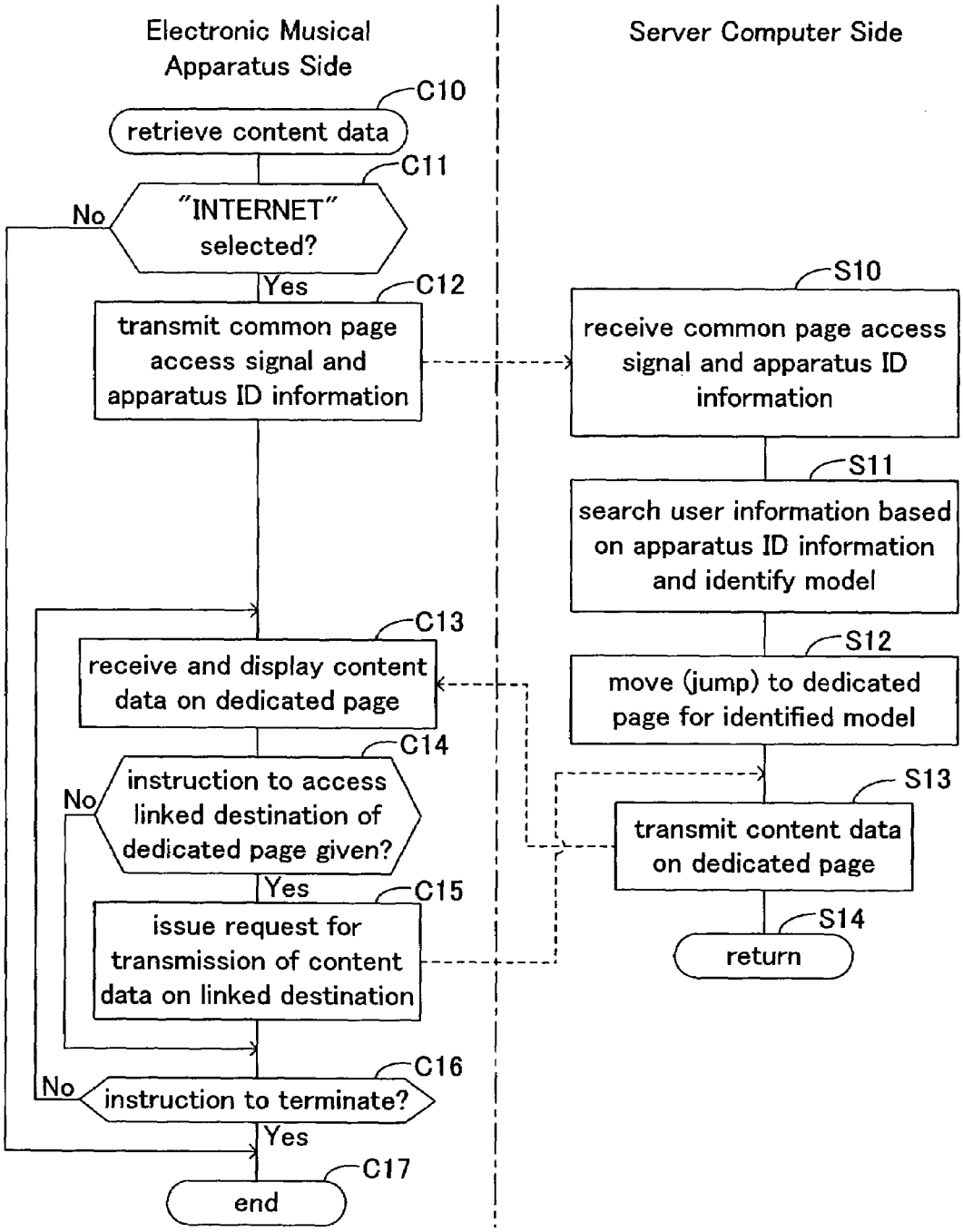
FIG. 7 is a flowchart illustrating a content data retrieval program according to the first embodiment of the present invention.

In the ROM 33, as shown in FIG. 3, there are provided various storage areas. In a program storage area there are stored a system program, some of the programs for implementing various functions of the electronic musical apparatus M1, and a later-described program for the electronic musical apparatus that is shown in FIG. 7. In a style data storage area there is stored a series of accompaniment control data for controlling generation of accompaniment tones, the data being provided for each type of automatic accompaniments such as jazz, rock, waltz and march that are applicable to the electronic musical apparatus M1. In a music piece data storage area there is stored automatic performance data for demonstration that is applicable to the electronic musical apparatus M1 to carry out automatic performance.

In a tone color data storage area there is stored a tone color table which stores names of tone colors applicable to the electronic musical apparatus M1, with the tone color names categorized. The tone color data storage area also stores tone color parameter groups provided for each tone color in order to generate a tone signal of each tone color in the later-described tone generator 41. In an effect data storage area there is stored an effect table which stores names of effects applicable to the electronic musical apparatus M1, with the effect names categorized. The effect data storage area also stores effect parameter groups provided for each effect to be added to a tone signal in the tone generator 41.

In a registration data storage area there are stored sets of registration data. Each set of registration data is composed of different kinds of control data for controlling various generation conditions of a tone signal such as tone color, effect and style (type of automatic accompaniment pattern) of a tone signal. The electronic musical apparatus M1 is designed such that an operation of specifying a set of registration data realizes a certain controlled state of musical tone that would require various operations of the panel operators 12. In an additional data storage area there is stored information such as a unique apparatus ID which is previously allocated to an electronic musical apparatus M1 used by a user. Even among the same type of electronic musical apparatuses M1, each individual electronic musical apparatus M1 has its own unique apparatus ID. The apparatus ID can be a production number of the electronic musical apparatus which has been given to the electronic musical apparatus at time of the purchase of the electronic musical apparatus, unique apparatus ID information of the electronic musical apparatus (e.g. an identification number of the electronic musical apparatus) which is given to the user through a communication network or by post or delivery service after the purchase of the electronic musical apparatus, or something different. The apparatus ID can be previously stored in the ROM 33 but may be stored in flash memory, for example, at any given time after the purchase of the electronic musical apparatus.

The external storage device 35 includes a hard disk HD previously equipped in the electronic musical apparatus M1, various storage media applicable to the electronic musical apparatus M1 such as compact disk CD and flexible disk FD, and drive units for each storage medium in order to enable storing and reading of voluminous data and programs. In the storage media there are stored various programs and data that are the same types as those stored in the ROM 33 but different from them. More specifically, programs and data stored in these storage media include various kinds of programs, style data, music data, tone color data, effect data, registration data and other data.

The tone generator 41 generates musical tone signals in accordance with performance information (e.g., key-on signal, key-off signal, etc. input from the keyboard 11) sent from the CPU 31, adds various effects such as reverberation and chorus to the generated musical tone signals, and outputs the effect-added musical tone signals. Under the control by the CPU 31, musical tone elements including tone colors of tone signals to be generated by the tone generator 41 and effects to be added to the tone signals are controlled on the basis of control parameters including tone color parameters and effect parameters supplied from the ROM 33 or external storage device 35 (RAM 34 in some cases). To control musical tone elements and effects, generally, in addition to tone color parameters and effect parameters stored in the ROM 33 in associated relation with the tone color table, tone color parameters and effect parameters contained in the registration data stored in the ROM 33 or tone color parameters and effect parameters stored in the external storage device 35 are also used. However, the performance capabilities of the tone generator 41 vary among models; each model has its own limit on available musical tone elements including tone colors and effects to be added to tone signals.

Tone signals output from the tone generator 41 are supplied to a sound system 42. The sound system 42, which is composed of amplifiers, speakers, etc., generates musical tones corresponding to the supplied tone signals.

To the bus 20 an interface circuit 51 is also connected. The interface circuit 51 inputs various data such as automatic performance data and tone control data and various programs from an external electronic musical apparatus 52 such as an electronic musical apparatus or personal computer. The interface circuit 51 is allowed to connect with the server computer SC through the network NW (e.g., the Internet) in order to transmit/receive various content items, programs and data supplied by the server computer SC.

Since the electronic musical apparatus M2 is designed to have the same construction as the electronic musical apparatus M1, as shown in FIG. 2, each component of the electronic musical apparatus M2 functions in a manner similar to that of the electronic musical apparatus M1. Therefore, detailed descriptions of the electronic musical apparatus M2 will be omitted. However, the electronic musical apparatus M2 has a display unit 13' which is different from the display unit 13 of the electronic musical apparatus M1. More specifically, the display unit 13' of the electronic musical apparatus M2 is similar to the display unit 13 of the electronic musical apparatus M1 in that the display unit 13' is also configured by a liquid crystal display, etc., and displays characters, notes, graphics, and various content items retrieved from the server computer SC, however, the display unit 13' has a narrow display area (in other words, low resolution), and is capable of displaying only in black and white.

Figure 4:
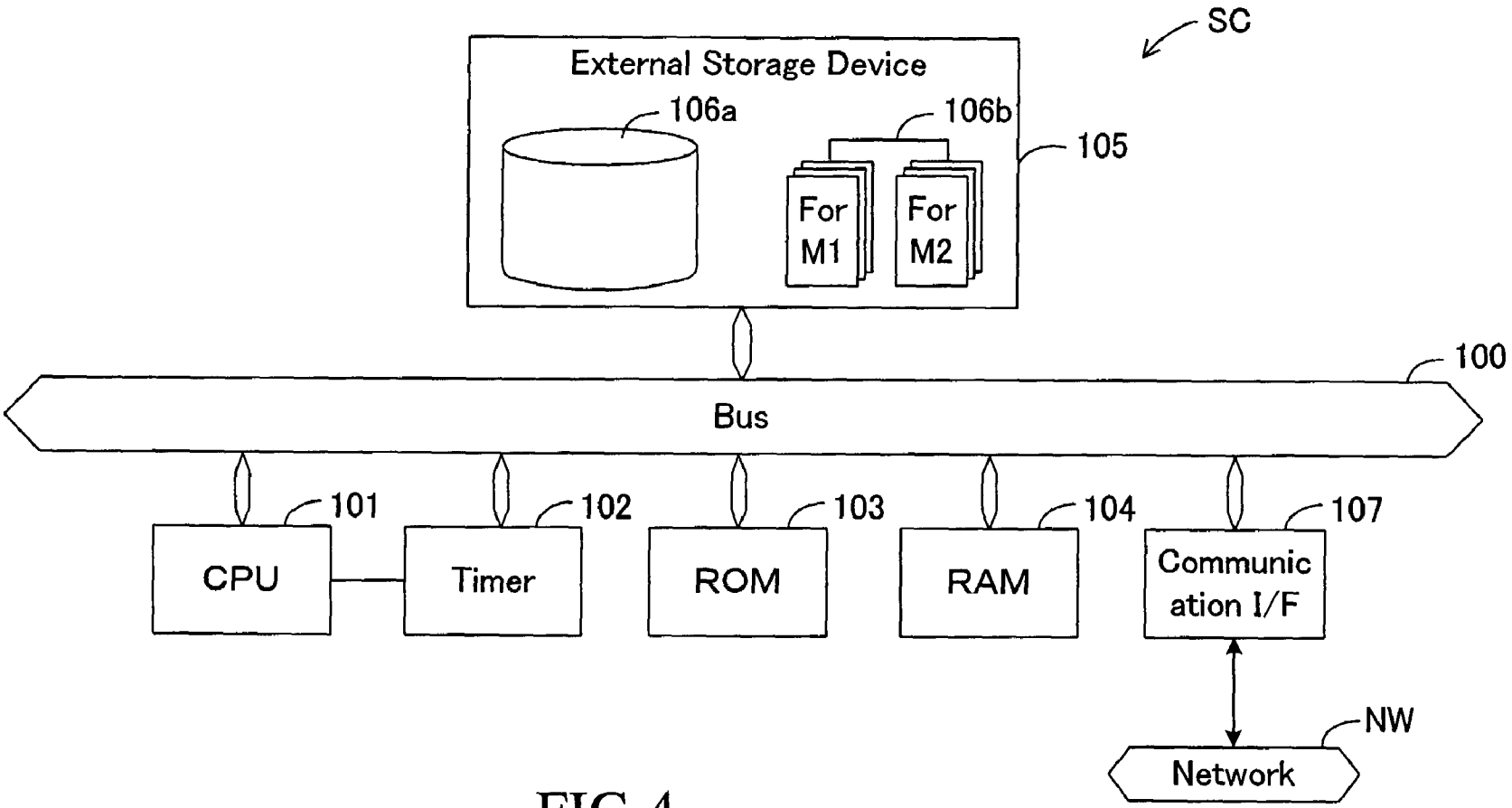
FIG. 4 is a schematic block diagram of the server computer according to the first and second embodiment of the present invention shown in FIG. 1.

As shown in a block diagram of FIG. 4, the server computer SC has a CPU 101, timer 102, ROM 103, RAM 104 and external storage device 105 that are connected to a bus 100. The CPU 101 runs programs in order to control various operations of the server computer SC across-the-board. The timer 102 counts time. In the ROM 103 there are previously stored a system program, some of the programs necessary for realizing various functions of the server computer SC and various data. In the RAM 104 there are temporarily stored programs and files to be used at the execution of the programs.

The external storage device 105 includes various storage media such as a hard disk HD, compact disk CD and flexible disk FD and drive units for the storage media. These storage media are capable of storing and reading voluminous data and programs, storing various programs including a later-described program for server computer shown in FIG. 7. In the hard disk HD there are constructed a user database **106*a* and content data storage section 106*b***.

In the user database **106*a* there is stored information for identifying the user and model of the electronic musical apparatuses M1 and M2, more specifically, information on username, password and apparatus ID information and model information (e.g., M1 and M2). The above information is stored in corresponding relation to each other (bound to each other) in order to allow searching. The electronic musical apparatuses M1 and M2 are designed such that the information on username, password and apparatus ID and model information is cataloged into the server computer SC at the purchase of the electronic musical apparatuses M1 and M2** or at desired time after the purchase.

In the content data storage section 106*b* there is stored content data representative of various information provided for the electronic musical apparatuses M1 and M2. The content data is created in consideration of display capabilities and operational capabilities of the electronic musical apparatuses M1 and M2 for which the data is to be provided. More specifically, the display units 13 and 13' of the electronic musical apparatuses M1 and M2 vary in display area (resolution) and capability of displaying in color. In consideration of display capabilities of the electronic musical apparatuses M1 and M2, for example, content data to be provided for the electronic musical apparatus M1 is created such that characters are displayed in a larger size with colored images, while content data to be provided for the electronic musical apparatus M2 is created such that characters are displayed in a smaller size with black and white text display. For electronic musical apparatuses capable of displaying moving images, content data including moving images is created, while for electronic musical apparatuses incapable of displaying moving images, content data without moving images is created. In consideration of the number and types of operators and the placement of the operators, furthermore, content data is created to have a screen layout on which the user can easily operate the operators. In a case where the display units 13 and 13' have four operators in their circumference, for instance, the screen layout can be adapted such that four menu items are displayed, while in a case of eight operators, the screen layout can be adapted to display eight menu items.

Content data used here indicates data in general (HTML data, text data, MIDI data, binary data, etc.) that is transmitted from the server computer SC to the electronic musical apparatuses M1 and M2. More specifically, content data includes data on product information, music data that the user desires to purchase, data contained in e-mail messages and bulletin boards, and so on. As for e-mail messages, the content data storage section 106*b* stores data that the server computer SC has transmitted/received from/to an external apparatus by well-known manner. In this case, for instance, the e-mail data is stored in association with a user's e-mail address.

As described above, content data is adapted to be displayed appropriately only on a specific electronic musical apparatus. More specifically, content data is created for each model of electronic musical apparatuses and stored in the content data storage section 106*b*. As mentioned above, content data to be provided for an electronic musical apparatus is displayed appropriately only on a specific model, that is, on a model having a specific display capability. In the following description, therefore, a screen displayed on a basis of content data provided for the respective electronic musical apparatuses M1 and M2 will be referred to as a dedicated page.

Also connected to the bus 100 is a communication interface circuit 107 (hereinafter referred to as communication I/F 107). The communication I/F 107 is connected to the network NW, so that the server computer SC is capable of communicating with users' electronic musical apparatuses M1 and M2.

Figure 5A:
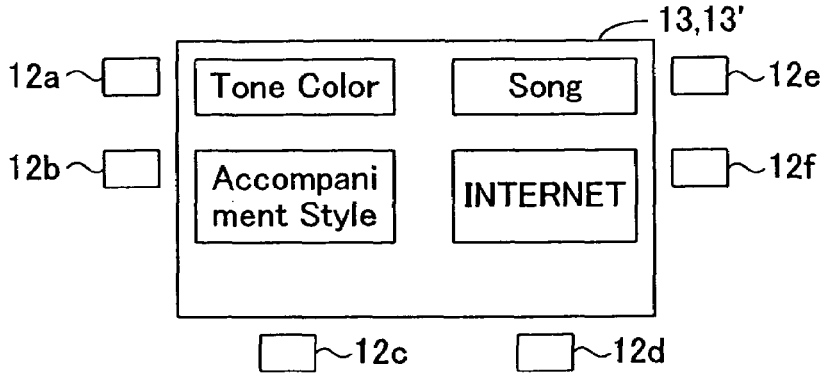
FIGS. 5A to 5D show examples of a display screen displayed on a display unit shown in FIG. 2.

Next explained will be operations of a first embodiment constructed as described above. First, general operations of the electronic musical apparatuses M1 and M2 will be briefly described. A user of the electronic musical apparatus M1 or M2 operates the panel operators 12 to specify the style (type of accompaniment tone) and tone color of tone signals to be generated by the tone generator 41, the effect to be added to the tone signals, and so on. This specification will be concretely described with reference to FIGS. 5A to 5D. When the user starts the electronic musical apparatus M1 or M2, the CPU 31 runs a specified program (not shown) that is stored in the ROM 33 in order to display an initial screen (top menu screen) on the display unit 13 or 13' as shown in FIG. 5A. The user then selects an item in accordance with the top menu screen displayed on the display unit 13 or 13'. At the time of this selection, the user depresses one of pushbuttons 12*a* to 12*f* that comprise the panel operators 12 in order to select a desired item. The respective pushbuttons 12*a* to 12*f* are disposed near each item of the top menu screen displayed on the display unit 13 or 13'.

Figure 5B:
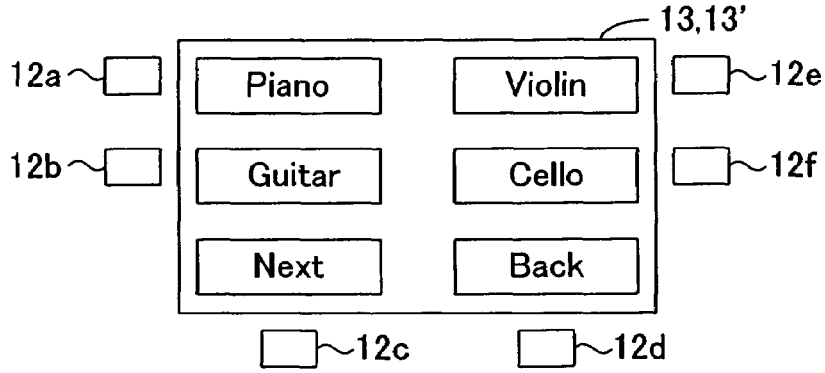
Figure 5C:
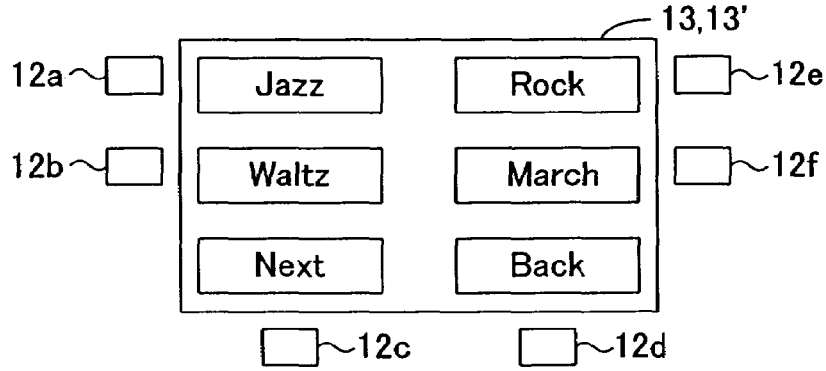
Figure 5D:
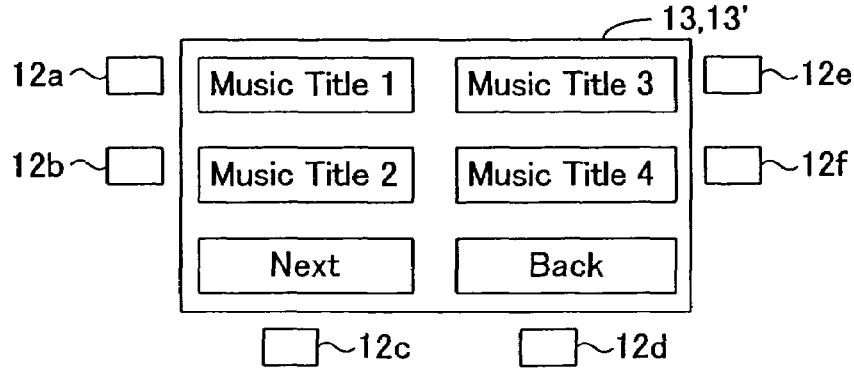

More specifically, when the pushbutton 12*a* disposed next to "TONE COLOR" displayed on the display unit 13 or 13' is depressed, the CPU 31 refreshes the display screen of the display unit 13 or 13' as shown in FIG. 5B. The user then depresses one of the pushbuttons 12*a* to 12*f* disposed next to names of possible tone colors, and "NEXT" representative of moving the screen forward and "BACK" representative of moving the screen backward in order to select his/her desired tone color. When the pushbutton 12*b* disposed next to "ACCOMPANIMENT STYLE" is depressed on the top menu screen, the CPU 31 refreshes the display screen of the display unit 13 or 13' as shown in FIG. 5C. The user then depresses one of the pushbuttons 12*a* to 12*f* disposed next to names of possible accompaniment styles, and "NEXT" and "BACK" in order to select his/her desired accompaniment style. When the pushbutton 12*e* disposed next to "SONG" is depressed on the top menu screen, the CPU 31 refreshes the display screen of the display unit 13 or 13' as shown in FIG. 5D. The user then depresses one of the pushbuttons 12*a* to 12*f* disposed next to titles of possible music pieces, and "NEXT" and "BACK" in order to select his/her desired music piece.

By the above-described operations, various data on tone color, effect, accompaniment style and music piece stored in the ROM 33 or external storage device 35 is transmitted to the tone generator 41 or written into the RAM 34. Then, user's performance operation by use of the keyboard 11 causes the tone generator 41 to generate, in accordance with the user's performance operation, tone signals having user's desired tone color and effect. In addition, the tone generator 41 is caused to generate the tone signals in an automatic performance pattern that corresponds to the above-selected desired accompaniment style or to generate accompaniment tone signals corresponding to the desired accompaniment style in parallel with the tone signals generated in accordance with the user's performance operation. Furthermore, the tone generator 41 is also able to generate automatic performance signals that correspond to the above-selected music piece. Tone signals generated by the tone generator 41 are then supplied to the sound system 42 and emitted from the sound system 42 as musical tones.

When the user depresses the pushbutton 12*f* disposed next to "INTERNET" displayed on the top menu screen, the user can access the server computer SC through the network NW to retrieve various content data. Hereinafter, the retrieval of content data will be described.

Figure 6:
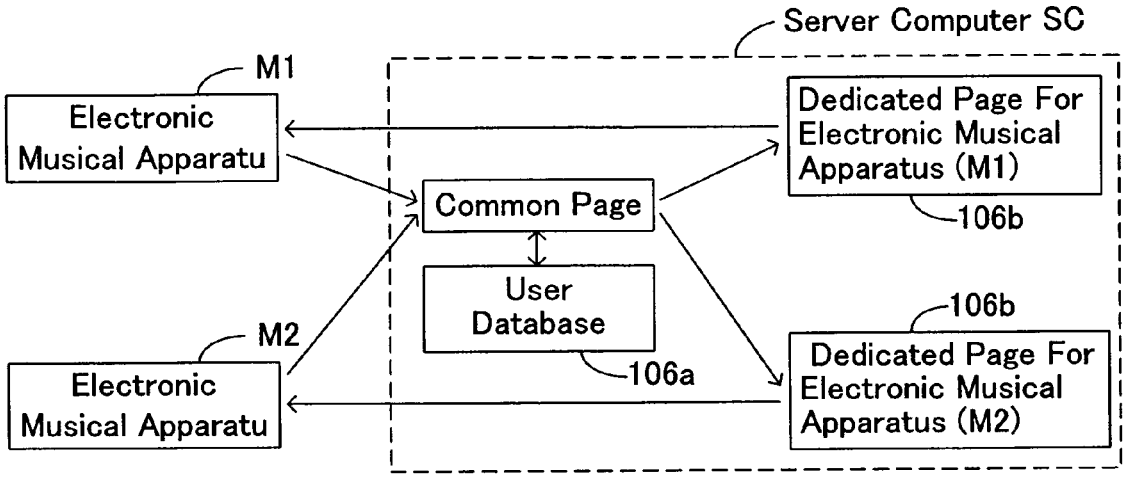
FIG. 6 is a schematic diagram illustrating flows of content data retrieval between the electronic musical apparatuses and server computer according to the first embodiment of the present invention.

In the first embodiment, as briefly shown in FIG. 6, the electronic musical apparatus M1 or M2 retrieves, from the server computer SC, content data, that is, a dedicated page that is applicable to the respective apparatus. More specifically, the electronic musical apparatus M1 or M2 accesses a common page of the server computer SC. The server computer SC uses the user database 106*a* to identify the model of the electronic musical apparatus M1 or M2. The server computer SC then moves to the respective dedicated page in order to allow the electronic musical apparatus M1 or M2 to display the respective dedicated page, and transmits specified content data contained in the dedicated page to the electronic musical apparatus M1 or M2.

The above retrieval of content data will be described in detail with reference to the flowchart of a content data retrieval program shown in FIG. 7. Retrieving content data, the electronic musical apparatuses M1 and M2 run the same content data retrieval program to retrieve content data. In the following description, therefore, detailed explanation will be given with an example of the electronic musical apparatus M1. The content data retrieval program is executed by the CPU 31 of the electronic musical apparatus M1 and the CPU 101 of the server computer SC. More specifically, the CPU 31 starts running the content data retrieval program at predetermined short periods at step C10 and determines at step C11 whether "INTERNET" has been selected by the user. When the pushbutton 12*f* has not been depressed by the user on the top menu screen, the CPU 31 gives "No" at step C11 and proceeds to step C17 to temporarily terminate the program.

When the pushbutton 12*f* has been depressed by the user, on the other hand, the CPU 31 gives "Yes" at step C11 and proceeds to step C12. At step C12 the CPU 31 transmits, to the CPU 101 of the server computer SC, apparatus ID information and a common page access signal necessary for accessing the common page. More specifically, the CPU 31 retrieves common page access information (e.g., URL (Uniform Resource Locator) information of the common page) necessary for finding the storage area of the common page data that has been previously stored in the ROM 33. The CPU 31 also retrieves apparatus ID information stored in the ROM 33 or the like. Through the interface circuit 51 and network NW, the CPU 31 then transmits the common page access signal on the basis of the retrieved common page access information along with the apparatus ID information.

On the server computer SC, the CPU 101 receives, at step S10, the common page access signal and apparatus ID information transmitted by the transmission process of step C12, and temporarily stores the above-received common page access signal and apparatus ID information in the RAM 104. At this process, the CPU 101 may be adapted to conduct a transmission process that is not shown in order to transmit content data necessary for displaying the common page to the electronic musical apparatus M1. Then, the electronic musical apparatus M1 receives the content data and displays the common page on the display unit 13. The CPU 101 may also be adapted to prompt the user to enter the username and password at the transmission of the content data that constitutes the common page. The entry of the username and password prevents unauthorized users from accessing the server computer SC, ensuring security.

After the reception process of step S10, the CPU 101 identifies the model of the electronic musical apparatus M1 at step S11. More specifically, the CPU 101 refers to common page data descriptive of a program for identifying the model and, on the basis of the apparatus ID information temporarily stored in the RAM 104, searches the user database 106*a* for the model of the electronic musical apparatus M1. That is, the CPU 101 retrieves model information that has been stored in association with apparatus ID information that matches the apparatus ID information stored in the RAM 104. By the above-described process, the CPU 101 identifies the model of the electronic musical apparatus M1 that is currently accessing the server computer SC, and proceeds to step S12.

At step S12 the CPU 101 retrieves menu content data constituting a dedicated page applicable to the identified model. On the basis of the model information retrieved by the process of step S11, more specifically, the CPU 101 moves (jumps) to the dedicated page applicable to the model and retrieves previously stored page access information (URL) of the dedicated page for leading the electronic musical apparatus M1 to display the dedicated page. At step S13 the CPU 101 transmits the menu content data of the dedicated page to which the CPU 101 moved through the communication I/F 107 and network NW to the electronic musical apparatus.

On the electronic musical apparatus M1, the CPU 31 receives at step C13 the menu content data transmitted by the transmission process of step S13 and displays a menu screen of the dedicated page on the display unit 13. More specifically, the CPU 31 receives the menu content data through the interface circuit 51 and network NW, and temporarily stores the received data at a specified storage area of the RAM 34. The CPU 31 then supplies the menu content data to the display control circuit 16 via the bus 20, and causes the display unit 13 to display the menu screen of the dedicated page on the basis of the supplied data.

Figure 8A:
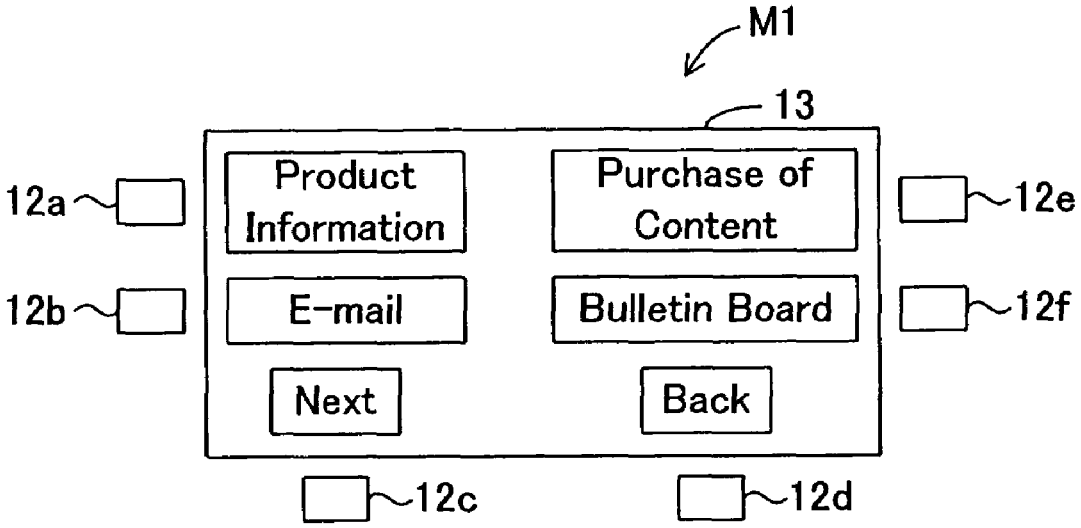
FIGS. 8A and 8B show examples of a dedicated page displayed on the display unit shown in FIG. 2.

In accordance with the CPU 31, the display control circuit 16 controls the display unit 13 on the basis of the retrieved menu content data, and displays the menu screen of the dedicated page as shown in FIG. 8A. On the basis of the display capabilities of the display unit 13, characters, etc. of the menu screen of the dedicated page are displayed in large size with colored images added. Thus, the display control circuit 16 enables the user to see the menu of the dedicated page, allowing the user to depress one of the pushbuttons 12*a* to 12*f* to select his/her desired content item.

Figure 8B:
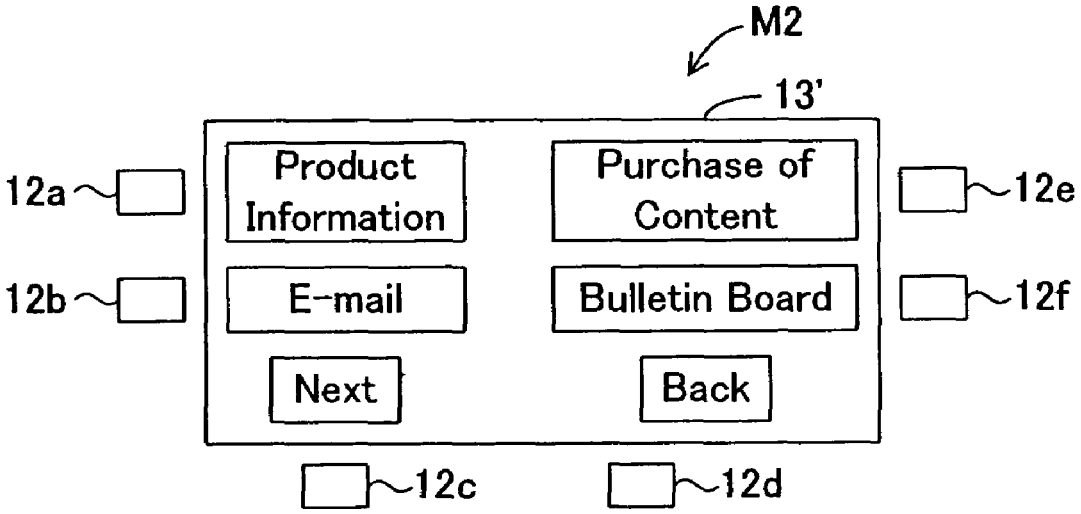

In a case where the electronic musical apparatus M2 executes the above-described steps to display a menu screen of its dedicated page, on the other hand, on the basis of the display capabilities of the display unit 13', characters, etc. of the menu screen of the dedicated page are displayed in small size with black and white text display capability as shown in FIG. 8B. Therefore, even when characters to be displayed are large in number, for example, the characters are displayed in small size in accordance with the display area of the display unit 13' to allow all the information to be displayed on a screen.

After the display process of step C13, the CPU 31 proceeds to step C14 where the CPU 31 determines whether an instruction to access a linked destination in the dedicated page has been given. More specifically, the user selects a linked destination by depressing, among the pushbuttons 12*a* to 12*f* representative of menu item names of the currently displayed dedicated page, one pushbutton which is disposed next to an item name that he/she desires to retrieve from the server computer SC. When one of the pushbuttons 12*a* to 12*f* has been depressed to select a linked destination, the CPU 31 gives "Yes" at step C14 and proceeds to step C 5.

At step C15 the CPU 31 issues a request for the transmission of content data on the linked destination selected by the user at step C14 to the server computer SC. More specifically, respective pieces of information representative of linked destinations (e.g., URL information, etc.) contained in menu content data of the dedicated page are associated with respective pushbuttons 12*a* to 12*f* disposed next to menu item names. When one of the pushbuttons 12*a* to 12*f* is depressed by the user, the information representative of the linked destination with which the depressed pushbutton is associated is read out and supplied to the CPU 31 via the bus 20. On the basis of the supplied information on the linked destination, the CPU 31 then issues, to the server computer SC, a request for the transmission of the linked destination, that is, the content data stored in a specified storage area of the content data storage section 106*b*.

On the server computer SC, the CPU 101 receives the transmission request issued by the process of step C15, and retrieves content data of the appropriate dedicated page at step S13. More specifically, the CPU 101 retrieves appropriate content data from the content data storage section 106*b* on the basis of the received information representative of the linked destination. The CPU 101 then transmits the retrieved content data via the communication I/F 107 and network NW to the electronic musical apparatus M1. On the electronic musical apparatus M1, the CPU 31 executes process of steps C13 to C15 again to display the user's selected dedicated page.

At step C14, on the other hand, if one of the pushbuttons 12*a* to 12*f* has not been depressed by the user, the CPU 31 gives "No" and proceeds to step C16 because no linked destination has been selected. At step C16 the CPU 31 determines whether an instruction to terminate the retrieval of content data from the server computer SC has been given by the user. More specifically, when a termination instruction is not given by the user, the CPU 31 gives "No" and returns to step C13 again to repeat the processes of steps C13 to C15 until the termination instruction is given. If the termination instruction has been given by the user, on the other hand, the CPU 31 gives "Yes" at step C16 and proceeds to step C17 to temporarily terminate the content data retrieval program.

According to the present embodiment, as is evident from the above descriptions, the electronic musical apparatus M1 and electronic musical apparatus M2 are capable of receiving content data, that is, dedicated page data that is applicable to the display capabilities and operational capabilities of the display units 13 and 13' by sending apparatus ID information at the connection with the server computer SC disposed on the network NW. As a result, even when the display capabilities (e.g., display area, resolution, and capability of displaying in color) of the display unit 13 and the display unit 13' vary among models of the electronic musical apparatuses, respective electronic musical apparatuses are able to retrieve information that is best suited to the display capabilities of the respective display units 13 and 13', allowing respective users to easily view the information. Since the electronic musical apparatus M1 and the electronic musical apparatus M2 can share a destination where the electronic musical apparatuses M1 and M2 first access as a common page, in addition, the same dedicated page access information can be shared among different types of electronic musical apparatuses. Furthermore, the number of operators of the electronic musical apparatus can be reduced because the pushbuttons 12*a* to 12*f* are commonly used to specify both the fundamental capabilities of the electronic musical apparatus (selection of tone color, song, accompaniment style, etc.) and an item provided on a dedicated page screen.

Moreover, the server computer SC stores various content data created on the basis of the display capabilities and operational capabilities of the display unit 13 and display unit 13' disposed on the electronic musical apparatus M1 and electronic musical apparatus M2. Therefore, the server computer SC is able to provide the electronic musical apparatus M1 or electronic musical apparatus M2 that is connected to the server computer SC with information that is suitable for the display capabilities of the respective apparatuses. Due to the content data stored in the server computer SC, the users of the electronic musical apparatus M1 and electronic musical apparatus M2 are able to easily view the provided content data, that is, a dedicated page. Furthermore, the apparatus ID will not be transmitted to any site other than a specific domain (dedicated site) in order to prevent the apparatus ID from being retrieved by a general site other than a dedicated site and being stored in associated relation with personal information such as username. Therefore, it is preferable to place restrictions on the electronic musical apparatuses M1 and M2 such as refraining from transmitting an apparatus ID in a case where the security of routes is not ensured by the SSL (Secure Socket Layer), etc.

2. Second Embodiment

Figure 9:
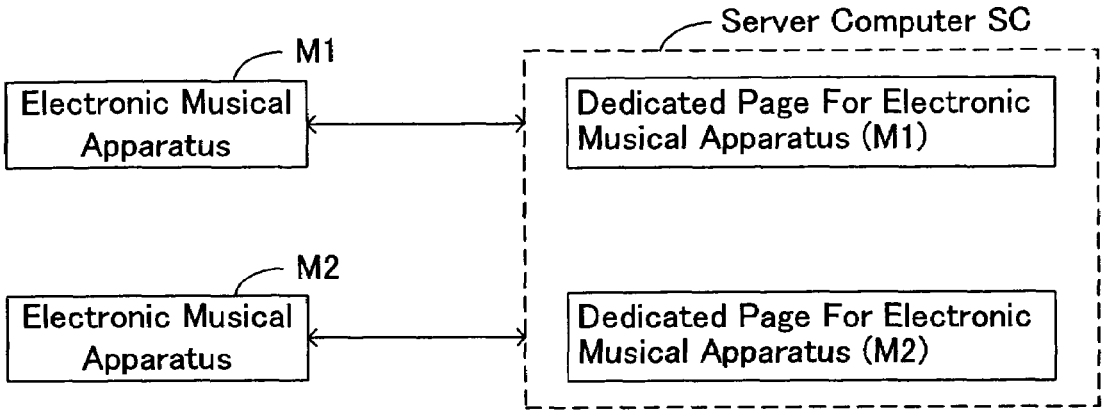
FIG. 9 is a diagram illustrating flows of content data retrieval between the electronic musical apparatuses and server computer according to the second embodiment of the present invention.

The above-described first embodiment is designed such that the electronic musical apparatuses M1 and M2 access a common page in order to retrieve content data of a dedicated page from the server computer SC. In the first embodiment, furthermore, the server computer SC is designed to identify the model of the electronic musical apparatus M1 or M2 that has accessed the common page and to move (jump) to a dedicated page applicable to the identified model to transmit the dedicated page. As briefly shown in FIG. 9, however, the first embodiment may be modified such that the respective electronic musical apparatuses M1 and M2 directly retrieve content data of a dedicated page from the server computer SC, omitting the access to the common page. Hereinafter, the second embodiment will be explained with the same numbers being given to the parts that are common between the first embodiment and the second embodiment in order to omit detailed explanation.

Figure 10:
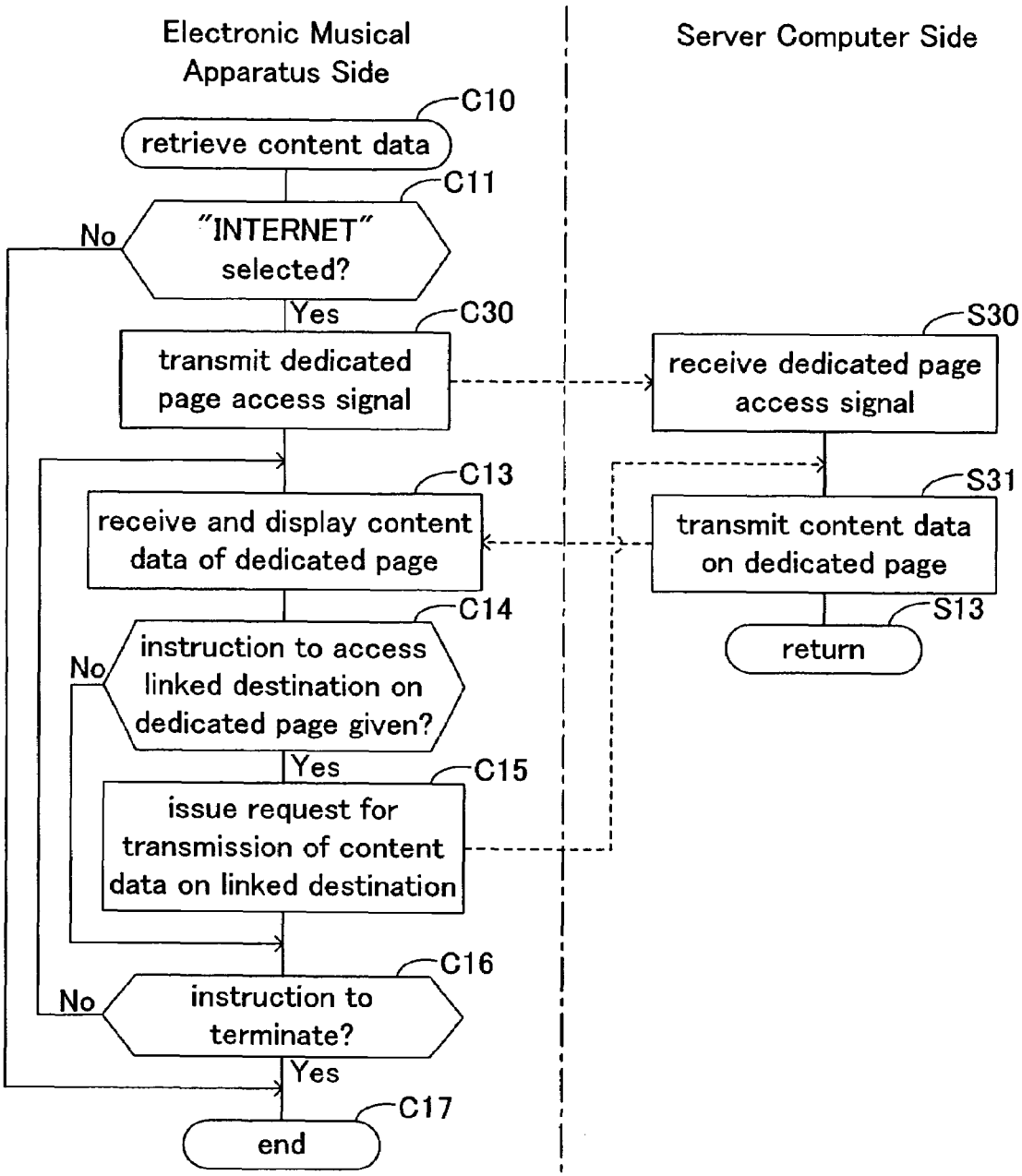
FIG. 10 is a flowchart illustrating a content data retrieval program according to the second embodiment of the present invention.

In the content data retrieval program of the second embodiment, step C12 and steps S10 to S13 of the flowchart of FIG. 7 are modified to step C30 and steps S30 and S31 as shown in the flowchart of FIG. 10. That is, at step C30 the CPU 31 transmits a dedicated page access signal for accessing a dedicated page to the CPU 101 of the server computer SC. More specifically, the CPU 31 retrieves dedicated page access information (e.g., URL information) provided for each type of electronic musical apparatuses, the dedicated page access information being previously stored in the ROM 33. The CPU 31 then transmits the dedicated page access signal on the basis of the retrieved dedicated page access information to the server computer SC via the interface 51 and network NW.

On the server computer SC, at step S30 the CPU 101 receives the dedicated page access signal transmitted by the transmission process of step C30 and temporarily stores the received signal in the RAM 104. At this process, the CPU 101 may prompt the user to enter the username and password by a transmission process which is not shown. The entry of the username and password prevents unauthorized users from accessing the server computer SC, ensuring security.

After the reception process of step S30, at step S31 the CPU 101 retrieves content data constituting a dedicated page applicable to the electronic musical apparatus M1 or the electronic musical apparatus M2 and transmits the content data to the electronic musical apparatus M1 or M2. More specifically, the CPU 101 retrieves the content data constituting a dedicated page applicable to the electronic musical apparatus M1 or the electronic musical apparatus M2 from the content data storage section 106*b*. The CPU 101 then transmits the stored content data to the electronic musical apparatus M1 or the electronic musical apparatus M2 via the communication I/F 107 and network NW.

After the transmission of the content data of a dedicated page applicable to the electronic musical apparatus M1 or the electronic musical apparatus M2 from the server computer SC, the CPU 31 executes steps C13 and later as in the case of the above-described first embodiment. Due to the above-described steps, the electronic musical apparatus M1 and the electronic musical apparatus M2 are capable of directly retrieving the content data of a respective dedicated page from the server computer SC. As in the case of the first embodiment, therefore, the second embodiment also enables the display of a dedicated page that is suitable for the respective display units 13 and 13' of the electronic musical apparatuses M1 and M2, allowing users to easily view the content data, that is, a dedicated page. Furthermore, the second embodiment can omit a model identification process on the server computer SC because the electronic musical apparatuses M1 and M2 directly access their dedicated page. Alternatively, electronic musical apparatuses of the same type may share a common model ID so that the electronic musical apparatuses transmits the model ID to the server computer to allow the server computer to identify the model.

In the above-described first embodiment and second embodiment, the present invention has been explained with examples of the electronic musical apparatuses M1 and M2 having a form of an electronic musical instrument that is provided with the keyboard 11 as performance operators, however, the present invention can be applied to electronic musical apparatuses having various different forms of electronic musical instrument provided with a touch plate, push-buttons, strings, etc. as performance operators as far as such electronic musical instruments have a display unit and are capable of communicating with an external apparatus. Furthermore, the present invention may be widely applied to even electronic musical apparatuses such as a sequencer (an automatic performance apparatus), tone generator, mixer, effector and recorder, and computer apparatuses that do not have a form of an electronic musical instrument provided with performance operators but can generate musical tone signals and communicate with an external apparatus to retrieve various information on condition that those apparatuses have a display unit.

In carrying out the present invention, furthermore, it will be understood that the present invention is not limited to the above-described first embodiment and second embodiment, but various modifications may be made without departing from the spirit and scope of the invention.

What is claimed is:

1. An electronic musical apparatus for generating a musical tone signal and communicable with an external apparatus having a storage area accessible by at least another electronic musical apparatus to retrieve various dedicated information, the electronic musical apparatus comprising:

an operating portion operable by a user for executing various operations;

a display portion for legibly displaying tone control information necessary for controlling generation of the musical tone signal and the various information;

a storage portion for storing identification information that identifies at least the model of the electronic musical apparatus;

a transmitting portion for connecting to the external apparatus and transmitting the identification information stored in the storage portion to the external apparatus; and a receiving portion for receiving, from the external apparatus, the various dedicated information dedicated for the model of the electronic musical apparatus including display capabilities of the display portion or operational capabilities of the operating portion, wherein the display portion displays a dedicated screen for the model of the electronic musical apparatus.

2. An electronic musical apparatus according to claim 1, wherein the external apparatus is a server computer connected to a network.

3. An electronic musical apparatus according to claim 1, wherein the identification information includes a production number of the electronic musical apparatus or an identification number of the electronic musical apparatus given to a user after the purchase of the electronic musical apparatus.

4. An electronic musical apparatus for generating a musical tone signal and communicable with an external apparatus having at least a specific storage area dedicated for a particular model of the electronic musical apparatus-to retrieve various dedicated information therefrom, the electronic musical apparatus comprising:

an operating portion operable by a user for executing various operations;

a display portion for legibly displaying tone control information necessary for controlling generation of the musical tone signal and the various information;

a storage portion for storing connection information necessary for connecting to the specific storage area of the external apparatus and specifically dedicated for the model of the electronic musical apparatus;

a connecting portion for connecting to the specific storage area of the external apparatus on the basis of the connection information stored in the storage portion; and a receiving portion for receiving, from the specific storage area, the various dedicated information for the model of the electronic musical apparatus including display capabilities of the display portion or operational capabilities of the operating portion, wherein the display portion displays a dedicated screen for the model of the electronic musical apparatus.

5. An electronic musical apparatus according to claim 4, wherein the external apparatus is a server computer connectable to a network.

6. A server computer connectable to a network for providing an external terminal, which has a storage device that stores identification information that at least identifies the model of the external terminal, and a display unit, connected to the network with various dedicated information for the model of the external terminal, the server computer comprising:

a database for storing identification information necessary for identifying the model of the external terminal a storage portion for storing various information dedicated to the model of the external terminal identified;

a receiving portion for receiving the identification information from the external terminal;

a model identifying portion for searching the database on the basis of the identification information received by the receiving portion and identifying the model of the external terminal;

an information retrieving portion for retrieving the various dedicated information dedicated for the external terminal from the storage portion on the basis of the model specified by the model identifying portion; and an information providing portion for providing the external terminal with the various dedicated information retrieved by the information retrieving portion so that the display unit of the external device displays a dedicated screen for the model of the external device.

7. A server computer according to claim 6, wherein the various dedicated information is dedicated for the display capabilities of the display unit or operational capabilities of operators-of the external terminal.

8. A server computer according to claim 6, wherein the external terminal is an electronic musical apparatus for generating a musical tone signal.

9. A computer-readable medium storing a computer program for controlling an electronic musical apparatus, which has a storage device storing identification information for identifying at least the model of the electronic musical apparatus, and a display unit, for generating a musical tone signal and communicable with an external apparatus having a storage area accessible by at least another electronic musical apparatus to retrieve various dedicated information, the computer program including the instructions for:

connecting to the storage area of the external apparatus and transmitting the identification information;

receiving, from the external apparatus, the various dedicated information dedicated for display capabilities or operational capabilities for the model of the electronic musical apparatus; and displaying the received various dedicated information so that the display unit of the electronic musical apparatus displays a dedicated screen for the model of the electronic musical apparatus.

10. A computer-readable medium storing a computer program for controlling an electronic musical apparatus, which has a storage device storing connection information that at least provides the model of the electronic musical apparatus, and a display unit, for generating a musical tone signal and communicable with an external apparatus having a specific storage area dedicated specifically for the model of the electronic musical apparatus to retrieve various dedicated information, the computer program including the instructions for:

connecting, on the basis of the connection information provided by the electronic musical apparatus, the to the specific storage area of the external apparatus;

receiving, from the specific storage area of the external apparatus, the various dedicated information dedicated for display capabilities or operational capabilities for the model of the electronic musical apparatus; and displaying the received various information so that the display unit of the electronic musical apparatus displays a dedicated screen for the model of the electronic musical apparatus.

11. A computer-readable medium storing a computer program for controlling a server computer having a database storing identification information for identifying the model of an external terminal connected thereto via a network and a storage portion storing various dedicated information for the model of the external terminal, for providing the external terminal, which has a storage device for storing identification information that at least identifies the model of the external terminal and a display unit, with the various dedicated information, the computer program including the instructions for:

receiving, the identification information from the external terminal;

searching, on the basis of the received identification information, the database and identifying the model of the external terminal;

retrieving, on the basis of the identified model, the various dedicated information to be provided to the external terminal from the storage portion of the external terminal; and providing the external terminal with the retrieved various dedicated information so that the display unit of the external terminal displays a dedicated screen for the model of the electronic musical apparatus.

* * * * *